US011653163B2

(12) United States Patent
Anagnos

(10) Patent No.: US 11,653,163 B2
(45) Date of Patent: May 16, 2023

(54) HEADPHONE DEVICE FOR REPRODUCING THREE-DIMENSIONAL SOUND THEREIN, AND ASSOCIATED METHOD

(71) Applicant: Daniel P. Anagnos, Annapolis, MD (US)

(72) Inventor: Daniel P. Anagnos, Annapolis, MD (US)

( * ) Notice: Subject to any disclaimer, the term of this patent is extended or adjusted under 35 U.S.C. 154(b) by 0 days.

(21) Appl. No.: 16/998,206

(22) Filed: Aug. 20, 2020

(65) Prior Publication Data

US 2021/0067891 A1 Mar. 4, 2021

Related U.S. Application Data

(60) Provisional application No. 62/892,158, filed on Aug. 27, 2019.

(51) Int. Cl.
*H04S 7/00* (2006.01)
*H04S 5/00* (2006.01)

(52) U.S. Cl.
CPC ..... *H04S 5/00* (2013.01)

(58) Field of Classification Search
CPC . H04S 5/00; H04S 7/306; H04S 7/308; H04S 2420/01; H04R 1/1075; H04R 2205/022
See application file for complete search history.

(56) References Cited

U.S. PATENT DOCUMENTS

2016/0269849 A1* 9/2016 Riggs ..... H04R 29/00
2017/0094440 A1 3/2017 Brown et al.
2017/0272890 A1 9/2017 Oh
2018/0192226 A1* 7/2018 Woelfl ..... H04R 5/02
2018/0192228 A1* 7/2018 Woelfl ..... H04R 1/1083
2019/0037334 A1 1/2019 Acharya

OTHER PUBLICATIONS

International Search Report and Written Opinion for PCT/US20/47149 dated Nov. 20, 2020.
Meshram, et al; "P-HRTF Efficient Personalized HRTF Computation for High-Fidelity Spatial Sound"; Department of Computer Science, University of North Carolina, Chapel Hill, 2014.
Guezenoc, et al; Audio Engineering Society, "Convention Paper 10129: HRTF Individualization: A Survey", Oct. 2018.

* cited by examiner

*Primary Examiner* — Ping Lee
(74) *Attorney, Agent, or Firm* — Peter A. Nieves; Nieves IP Law Group, LLC

(57) ABSTRACT

3D audio virtualization within headphone-type sound reproduction devices, comprises: deriving an HRTF, comprising a PRTF, that includes acoustical effects due to pinnae and ear canals, and a remainder HRTF, that includes acoustical effects due to head, shoulders, torso and other body parts while excluding acoustical effects from pinnae and ear canals; wherein the remainder HRTF is electronically implemented and omits acoustical effects due to pinnae and ear canal effects; and wherein the PRTF is acoustically implemented and personalized to the user through use of two or more transducers positioned such that a front plane of the transducer, the front plane of the transducer's diaphragm, the transducer's mechanical center or the transducer's acoustical center point are 25 mm or more from a user's ear canal entrance, and/or oriented so the 0° axis of acoustical output is aligned with the acoustical output axes of typical external loudspeakers positioned in the acoustical far-field.

13 Claims, 5 Drawing Sheets

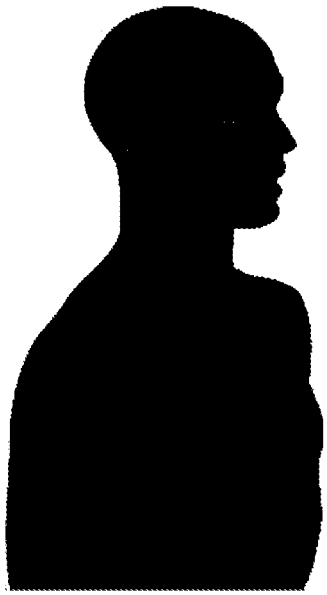

First Component HRTF

- Acoustical Effects from Head, Shoulders and Torso
- Low - Moderate Variation Between Individuals
- Lower Amplitude, Q and Frequency Effects
- Based on Acoustical Measurements (HATS)
- Modeled with Simple DSP Algorithms

+

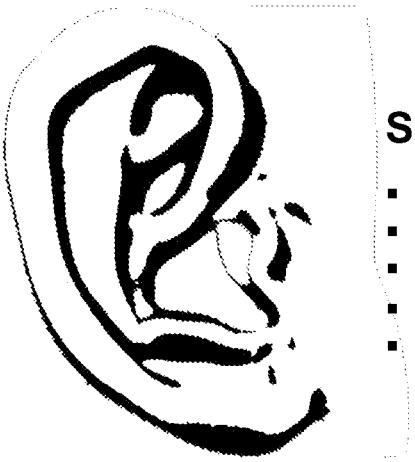

Second Component HRTF

- Acoustical Effects from Pinnae and Ear Canals
- Extreme Variation Between Individuals
- Higher Amplitude, Q and Frequency Effects
- No Measurements or Modeling
- Preserved Acoustically without Processing

=

FULLY INDIVIDUALIZED HRTF

FIG. 1

Note:
*For analog implementation this block is not required.
†These functions can be combined into a single block.
‡These functions can be combined into a single block.

HEADPHONE DEVICE FOR REPRODUCING THREE-DIMENSIONAL SOUND THEREIN, AND ASSOCIATED METHOD

CROSS-REFERENCE TO RELATED APPLICATIONS

This application claims the benefit of U.S. Provisional Patent Application Ser. No. 62/892,158, filed Aug. 27, 2019, entitled "Headphone device for Reproducing Three-Dimensional Sound Therein, and Associated Method," which is incorporated by reference herein in its entirety.

FIELD OF THE INVENTION

The present invention is related to high quality audio reproduction, and particularly to the reproduction of three-dimensional (3D) sound similar or superior to that reproduced by a large, external, high performance loudspeaker system.

BACKGROUND OF THE INVENTION

The quality of reproduced audio continues to improve. One audio characteristic that is highly desired is the providing of 3D audio, also referred to as 3D sound, where 3D or spatial characteristics are reproduced. Providing 3D audio in headphones is more difficult than with high performance loudspeaker systems. Generating a 3D audio experience similar to that possible with high performance loudspeakers using headphone type devices is conventionally termed "3D Audio Virtualization" and is an area of intense research in academia and product development in today's audio industry.

Most attempts of 3D Audio Virtualization for headphone type products utilize digital signal processing (DSP) and complex algorithms exclusively. The solutions are usually wholly processing-based, without any acoustical approach or element.

3D Audio Virtualization algorithms typically incorporate some form of Head-Related Transfer Function (HRTF) that is convolved with the audio signals in a playback device. These approaches are normally model-based, measurement-based or a combination thereof.

Model-based approaches attempt to simulate or emulate a nominal HRTF, based on averaged anthropomorphic data. The modeled HRTF is usually non-personalized and often lacking in accuracy due to the extraordinary degree of variation in human physiology, especially with pinnae. As a result, most model-based approaches have very limited effectiveness, and are unconvincing to many, if not most, users.

Measurement-based approaches attempt to generate a personalized HRTF through in-situ measurements of the end user. These measurements are either acoustical, using in-ear microphones or optical, using scans or photos. These types of measurement are very complex and difficult to perform properly; they are not convenient or simple enough for most end users to perform. Often the measurement data acquired is error-prone or inaccurate. For example, the acoustic measurements are dependent on acoustical conditions in the measurement environment, as well as the test and measurement system hardware; scans of the pinnae from a smartphone camera usually lack 3D (angle-dependent and depth) information or are missing crucial data for the head, torso and shoulders. Furthermore, even if the measurements are performed correctly and accurately, complex, computationally inefficient algorithms and digital signal processing are still required for convolution.

Hybrid approaches that combine measurement-based and model-based techniques recently have been introduced, but still suffer from similar problems and issues. Hybrid approaches often combine limited user measurements (usually photos) with predictive models to realize a pseudo-personalized HRTF. As expected, their effectiveness usually lies somewhere between model-based and measurement-based approaches. While they can be more convenient than a pure measurement-based approach, they still suffer from inadequate measurement data, modeling inaccuracies and require computationally intense DSP to realize.

All of the conventional approaches to 3D Audio Virtualization require complex algorithms and computationally intense, high precision digital signal processing to be effective solutions. As a consequence, such processing is expensive and requires significant power. Moreover, latency penalties from processing severely limit usability with video or interactive applications. In order to be compatible with lower cost mobile products and a wider range of applications, processing is typically compromised to such a degree that either the 3D Audio Virtualization is less effective, or the audio quality itself is degraded significantly, or both.

Therefore, there is a need in the industry to address one or more of these issues.

SUMMARY OF THE INVENTION

Embodiments of the present invention provide a system and method for reproducing three-dimensional sound. Briefly described, the method for providing 3D audio virtualization within headphone-type sound reproduction devices, comprises the steps of: deriving a composite Head-Related Transfer Function (HRTF) consisting of a cascade, or series combination, comprising a Pinna-Related Transfer Function (PRTF), that includes the acoustical effects due to pinnae and ear canals, and a remainder HRTF, that includes acoustical effects due to head, shoulders, torso and other body parts while excluding acoustical effects due to pinnae and ear canals; wherein the remainder HRTF is electronically implemented using either digital processing or analog processing, and omits the acoustical effects due to pinnae and ear canal effects; and wherein the PRTF component is acoustically implemented and personalized to the user through the use of two or more transducers that are positioned such that a front plane of the transducer, the front plane of the transducer's diaphragm, the transducer's mechanical center or the transducer's acoustical center point are located 25 mm or more from a user's ear canal entrance, and/or oriented such that the 0° axis of acoustical output is aligned with the acoustical output axes of typical external loudspeakers positioned in the acoustical far-field, defined as a spherical volume surrounding the user's head or ear canal with a radius of 1 meter or more, such that front left and right transducer devices' acoustical axes subtend an angle of between ±10°-80° (±28°-30° optimum) relative to the front forward orientation of the user's head, defined as 0°, and rear left and right transducer devices' acoustical axes subtend an angle of between ±110°-170° (±150°-152° optimum) relative to the front forward orientation of the user's head, defined as 0°.

Referring to the system, the system comprises a Pinnae-Related Transfer Function (PRTF) component that characterizes the acoustical effects of the pinnae and ear canal and a remainder HRTF component that characterizes the acoustical effects of the head, shoulders, torso, lap and other body parts, hereby the PRTF component can be realized by an acoustical means, through the use of two or more transducers oriented in a unique geometry relative to an ear canal entrance, such that the PRTF's amplitude and phase characteristics versus frequency will be replicated, and whereby the remainder HRTF component can be realized through signal processing by analog circuitry or DSP to replicate the remainder HRTF's amplitude and phase characteristics versus frequency.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The components in the drawings are not necessarily to scale, emphasis instead being placed upon clearly illustrating the principles of the present invention. The drawings illustrate embodiments of the invention and, together with the description, serve to explain the principals of the invention.

FIG. 1 is a schematic diagram illustrating the general relationship between the two HRTF components that when combined construct a fully individualized HRTF, in accordance with the present system and method.

DETAILED DESCRIPTION

Figure 2:
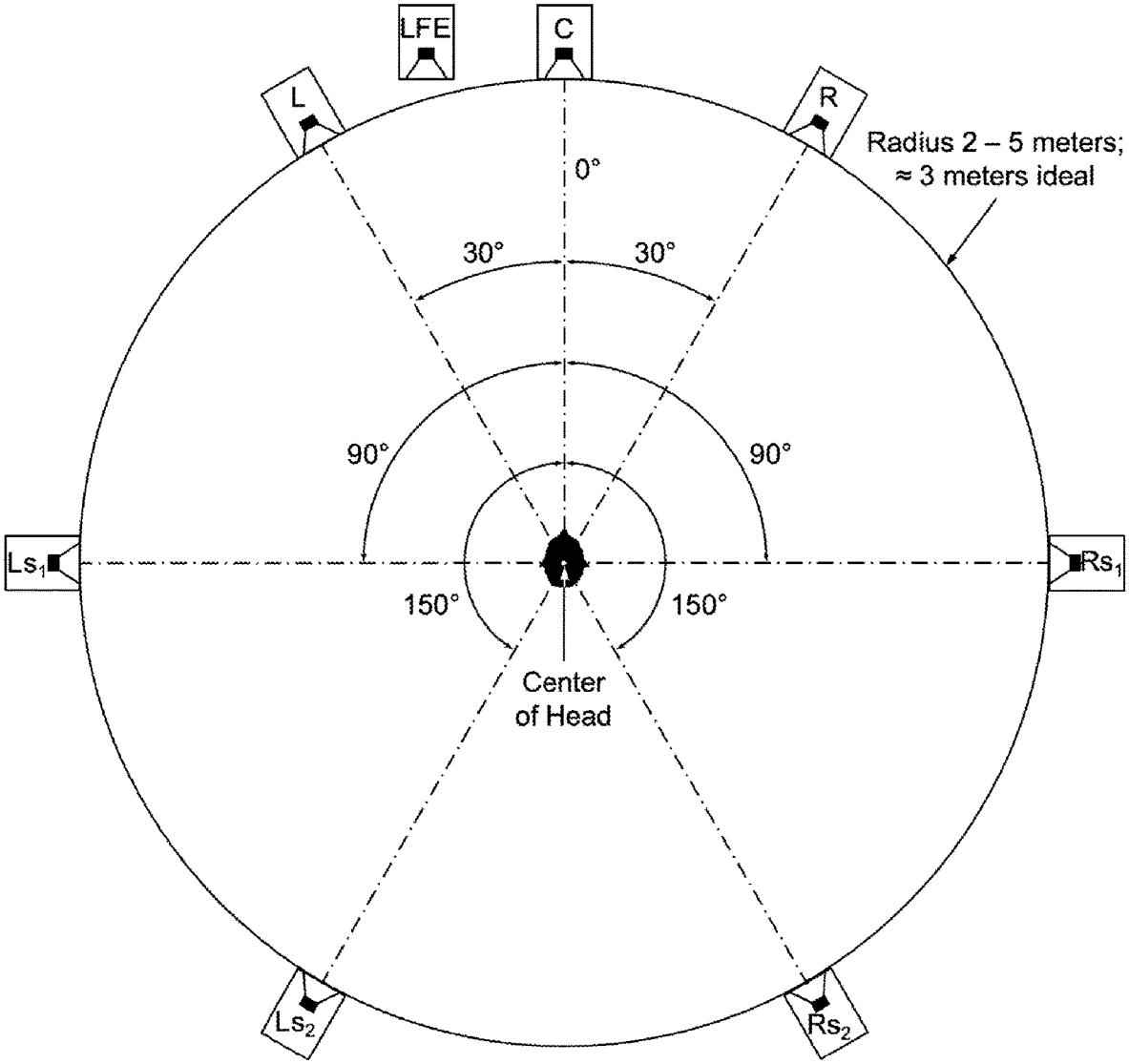
FIG. 2 is a schematic diagram showing the ITU-R (BS.775-2) recommendation for a 7.1 channel loudspeaker setup (playback system).

The present system and method applies to any stereo, multichannel or 3D audio signals and enables headphones or similarly-mounted small, "close-field" loudspeakers to reproduce three-dimensional sound similar or superior to that reproduced by a large, external, high performance loudspeaker system. The present invention allows realistic sonic images to be perceived outside of the listener's head, in the surrounding space, as would be perceived when listening to a high performance loudspeaker system in an ideal listening environment. Headphones cannot achieve this effect without utilizing individualized, Head-Related Transfer Functions, or HRTFs. A HRTF is a complex type of transfer function (mathematical equation) that fully characterizes the acoustical effects (primarily reflection and diffraction) of the human body when listening to sound. Individualized HRTFs are unique to each individual listener and vary significantly from person to person. Fully individualized HRTFs preserve three critical cues (spatial information) required by our brains to accurately localize sound in three dimensions: 1) Interaural Level or Intensity Difference (ILD or IID), 2) Interaural Spectral Difference (ISD) and 3) Interaural Time or Phase Difference (ITD or IPD). These informational cues will also vary significantly from person to person.

Headphones have two major advantages over loudspeakers that may allow for superior three-dimensional sound reproduction: 1) headphones prevent Interaural Crosstalk (acoustical crosstalk between left and right ears), and 2) headphones eliminate acoustical effects of the listening environment. Both of these can adversely affect ILD (BD), ISD and ITD (IPD) information and degrade our perception of three-dimensional sound. However, without individualized HRTFs, headphones cannot properly preserve interaural difference information (ILD, ISD and ITD) and hence fail to reproduce believable 3D sonic images outside of the listener's head.

Because of their complexity, individualized HRTFs are typically implemented in external, high performance digital signal processors (DSP). Furthermore, individualized HRTFs must be determined experimentally from extensive, personalized, in-situ measurements that are impractical for most consumer and professional audio applications.

The present system and method constructs individualized composite HRTFs using a unique and practical combination of acoustical and electrical (signal processing) based solutions. The individualized HRTFs can be deconstructed into a cascade, or series combination of, two fundamental components: 1) acoustical effects from the head, shoulders, torso and other body parts; and 2) acoustical effects from the pinnae (ear lobes) and ear canals. Together these two components constitute a true individualized HRTF. A first transfer function can be derived from the first component and effectively modeled in DSP (digital signal processing) within the headphone system. The head, torso and other body-related acoustical effects are comparatively low in amplitude, Q and frequency. Because this transfer function is relatively simple, the processing required is minimal and can be implemented within a low power, cost-effective DSP. The variation in this HRTF component is far less than the pinna and ear canal HRTF components and could, for example, be quantified by a few user-selectable options on the headphone.

The first component HRTF algorithms are predetermined and derived from specialized acoustical measurements performed using a modified Head and Torso Simulation (HATS) test fixture, within an anechoic environment (test chamber). The present system and method includes the methodologies of test, measurement and data acquisition required as well as the mathematical techniques of formulating the specific HRTF algorithms. The measurements need to be performed only once and apply to any headphone design or model.

A second transfer function can be derived from the pinnae and ear canal related acoustical effects that is highly individualized, extremely variable from individual to individual, and extraordinarily complex to model accurately in DSP. Pinna and ear canal effects generally occur between 3 kHz and 14 kHz, with large, high Q (quality factor) peaks and dips (>6 dB) in acoustical response. The present system and method does not attempt to measure, model or replicate these HRTF components; rather, it utilizes acoustical solutions that preserve the pinna and ear canal related acoustical effects for each individual listener, while preventing any alterations from occurring during normal use. In conventional headphones these effects are completely lost.

Attempts at replicating these effects using generic, averaged or mathematical models implemented in DSP are generally unsuccessful, and can seriously degrade audio quality.

The present system and method includes specialized transducers, unique mechanical geometry and novel acoustical elements within the headphone, each of which is described in detail herein. Preferably, the transducers are low profile in thickness, full-range, and are planar operational type transducers, although other types of transducers also may be used. The sound sources—both discrete (physical) and virtual—are located in the effective far-field relative to the ear canal and replicate key geometrical relationships. Furthermore, the present system design controls acoustic dispersion and prevents destructive interference between sound sources. Additional processing is required for multichannel audio reproduction, but is relatively simple and can be implemented in either the analog or digital domain. This technology is fully-compatible with head-tracking systems, which would maintain performance even with head rotation.

FIG. 1 is a schematic diagram illustrating the general relationship between the two HRTF components that when combined construct a fully individualized HRTF, in accordance with the present system and method. As shown by FIG. 1, the first component HRTF creates the first transfer function using the acoustical effects from the head, shoulders, torso, and other body parts. In addition, there is a low to moderate variation in the first component HRTF between different individuals. As previously mentioned, the head, torso and other body-related acoustical effects are comparatively low in amplitude, Q and frequency for the first component HRTF. Further, because the first component transfer function is relatively simple, the processing required is minimal and can be implemented within a low power, cost-effective DSP. The first component HRTF algorithms are also derived from specialized acoustical measurements performed on a HATS test fixture, as will be explained in more detail herein.

The second component HRTF creates the second transfer function using the acoustical effects from the pinnae and ear canals. Unlike in the first component HRTF, there is extreme variation in the second transfer function between different individuals. The pinnae and ear canal acoustical effects are higher in amplitude, Q and frequency effect than the head, torso and other body-related acoustical effects of the first component HRTF. In addition, as previously mentioned, attempts at replicating these effects using generic, averaged or mathematical models implemented in DSP are generally unsuccessful, and can seriously degrade audio quality. As a result, the present system and method does not attempt to measure, model or replicate these HRTF components, but instead, it utilizes acoustical solutions that preserve the pinna and ear canal related acoustical effects for each individual listener without processing, as explained in detail herein.

The present system and method uses head-tracking in the headphones, which can be implemented in the present system and method by reassigning or remapping designated audio reproduction (output) channels. This reassigning or remapping is essentially remixing levels and delays of each input channel within four designated output channels of the headphones, thereby altering locations of the virtual sound sources.

Technology of the present system and method is flexible and scalable in the sense that multiple embodiments are possible. For example, the first component HRTF can be approximated in accordance with the present system and method by using analog circuitry instead of a DSP. Alternatively, the second component HRTF acoustical solutions could be implemented alone, without the first component HRTF, even in completely passive designs. In such embodiments, performance would be reduced in order to achieve lower complexity and lower headphone cost.

The overview and description presented thus far constitutes one exemplary embodiment of the present invention, and pertains to larger, over-ear type headphone embodiments. Smaller over-ear and on-ear type headphones, as well as all in-ear type earphones (including "In Ear Monitors" or IEMs) cannot achieve a "personalized" acoustical HRTF component of the pinnae and ear canal since the transducers are either compressing the pinnae or are located too close, within the outer perimeter of the pinnae. As a result, an alternative embodiment of the invention compensates for the smaller transducer size and much closer orientation to the ear canal (<25 mm). Due to the reduction in "personalization" of the HRTFs for smaller over-ear and on-ear type headphones, as well as all in-ear type earphones, the alternative embodiment may not achieve the same level of acoustical performance (perceived 3D effect) as the first exemplary embodiment.

The technology of the present invention is equally applicable to stereo, multichannel (5.1, 7.1, 10.2, etc.) and 3-D (object-based) audio content, analog or digital sources and wired or wireless systems. Applications may include portable (mobile) and stationary (home/studio) headphones, headsets, headrests, etc. for music, home theater, gaming, AR/VR, automotive, aerospace and military trainers, etc. in professional, consumer and commercial markets.

System Acoustical Design

Figure 3:
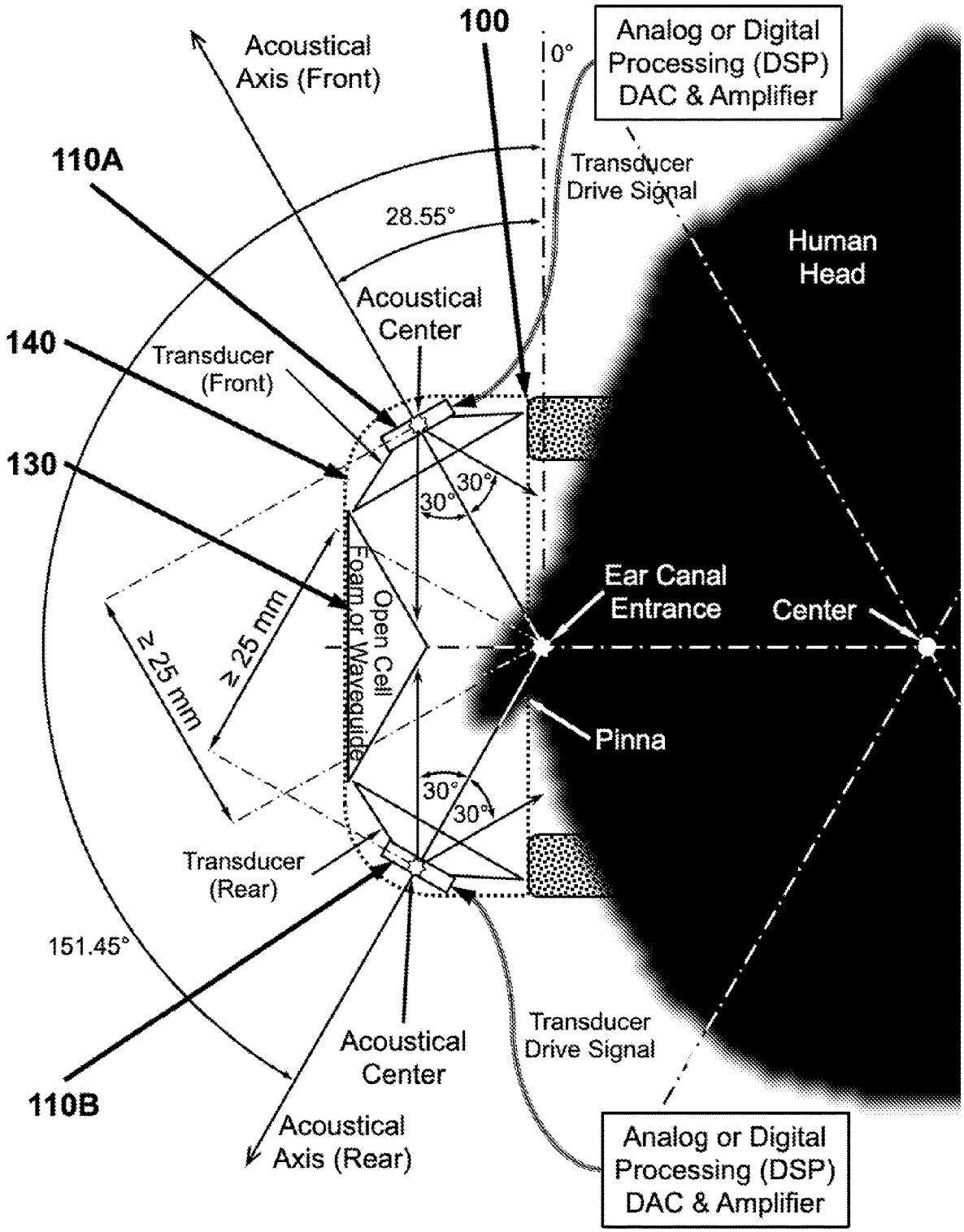
FIG. 3 is a schematic diagram that illustrates geometric relationships of the present multichannel headphone system design, in accordance with the first exemplary embodiment of the invention (left side only shown).

A headphone device 100 provided in accordance with the present invention contains a series of transducers 110A, 110B. FIG. 3 is a schematic diagram that illustrates geometric relationships of the present multichannel headphone system design, in accordance with the first exemplary embodiment of the invention (left side only shown). The transducers 110A, 110B receive an electrical input, "Transducer Drive Signal", which is a processed and amplified analog audio output signal that is further described in FIG. 5.

In the first exemplary embodiment, which includes larger, over-ear type headphones, transducers are located in the effective acoustic "far-field" relative to the ear canal entrance (X), the distance from the ear canal entrance to the acoustical center point of the transducer must be at least 25 mm (supported by recent sound localization research). It should be noted that the distance of 25 mm may alternatively be to a front plane of the transducer or a front plane of the transducer's diaphragm, or the mechanical center point of the transducer. This is illustrated by FIG. 3. It is noted that the ideal distance should be great than or equal to 40 mm. As is known by those having ordinary skill in the art, in the far field, the source is far enough away to essentially appear as a point in the distance, with no discernable dimension or size. At this distance, the spherical shape of the sound waves have grown to a large enough radius that one can reasonably approximate the wave front as a plane-wave, with no curvature. The present system and method emulates the acoustic far-field in two ways: 1) ensuring the transducer's produced wave front is a plane-wave instead of a spherical wave front, 2) locating the transducer at a distance from the ear canal entrance>the point where a typical HRTF becomes sensitive to distance (i.e., at a distance whereby the HRTF remains relatively constant and no longer changes significantly with distance).

Transducers 110A, 110B are located at the appropriate axial angle protracted from a unit circle as prescribed by the ITU, Dolby or DTS standard recommendations. While typically the center point of the circle is taken as the center of the listener's head, in accordance with the present system and method, the entrance of the ear canal is taken as the center point to facilitate practical implementation. Preferably, resultant angular error should be less than 1.5 degrees from the ideal center point. FIG. 2 is a schematic diagram showing the ITU-R (BS.775-2) recommendation for a 7.1 channel loudspeaker setup (playback system).

In accordance with the alternative embodiment of the invention, where smaller over-ear and on-ear type headphones are used, as well as all in-ear type earphones, transducers are located in the effective acoustic "near-field" relative to the ear canal entrance, instead of in the effective acoustic "far field" relative to the ear canal entrance. In the alternative embodiment, the distance from the ear canal entrance to the acoustical center point of the transducer is <25 mm.

In accordance with the present system and method, there should be a one-to-one angular correlation (relative to the ear canal entrance) between the position of each transducer and sound sources used in acoustical measurements for HRTF derivations. In addition, in stereo implementations of the first exemplary embodiment, the transducers are located forward of the pinnae. In multichannel implementations of the first exemplary embodiment, transducers are also located behind the pinnae. As a result, FIG. 3 is illustrating a multichannel implementation of the first exemplary embodiment.

In the alternative embodiment of the invention, where smaller over-ear and on-ear type headphones are used, as well as all in-ear type earphones, including "In Ear Monitors" (IEMs), all transducers may be compressing the pinnae or are located within the outer perimeter of the pinnae.

In accordance with the present system and method, transducers are angled such that their zero degree axis of acoustical output is aligned with the entrance to the ear canal. In the first exemplary embodiment, as shown by FIG. 3, output dispersion characteristics of the transducers 110A, 110B are such that a ±30 degree or less dispersion angle from the acoustical center point of the transducer (when mounted at the appropriate distance) completely engulfs the listener's pinnae, taking into account the largest variance of pinna dimensions, which is not possible in the alternative embodiment smaller over-ear and on-ear type headphones, as well as in-ear type earphones.

In multichannel implementations, it is beneficial to have an acoustical absorption device 130, such as, but not limited to, a shaped piece of acoustical foam, or an acoustical waveguide, located between front 110A and rear 110B transducers so as to minimize acoustical interference.

A front chamber portion of the ear cup 140, between transducer and ear, should be shaped and/or treated to minimize acoustical reflections that could corrupt the desired acoustical output. For example, gradual, smooth shaping of internal surfaces of the chamber (avoiding sharp discontinuities and parallel surfaces) will reduce diffraction and standing waves. Acoustical foam 130 could also be employed on the chamber surfaces and between the transducers 110A, 110B to absorb undesirable acoustical output such as reflections off chamber surfaces or interfering wave fronts from the two transducers 110A, 110B.

In closed-back headphone implementations, as shown by FIG. 3, the rear-facing output from each transducer 110A, 110B should be kept separate and isolated. In the first exemplary embodiment, transducers in the range of 30 mm-65 mm diameter can be utilized, although the present invention is not limited to this size range. Reduction of the transducer depth (front—rear) is desired to facilitate mounting within a reasonable size ear cup. Flat diaphragm transducers (planar magnetic, electret condenser and electrostatic) are preferred (though not required) in this type of design, as they may offer superior results due to their generation of truly planar acoustical wave fronts.

In accordance with the alternative embodiment of the invention, where smaller over-ear and on-ear type headphones are used, as well as all in-ear type earphones, transducers with much smaller diameters may be utilized (6 mm or less). Flat diaphragm transducers and transducers that produce a planar acoustical wave front are preferred in the alternative embodiment of the invention. Conventional electrodynamic, planar, electrostatic, electret condenser and balanced armature (BA) types of transducers can be utilized.

Figure 4:
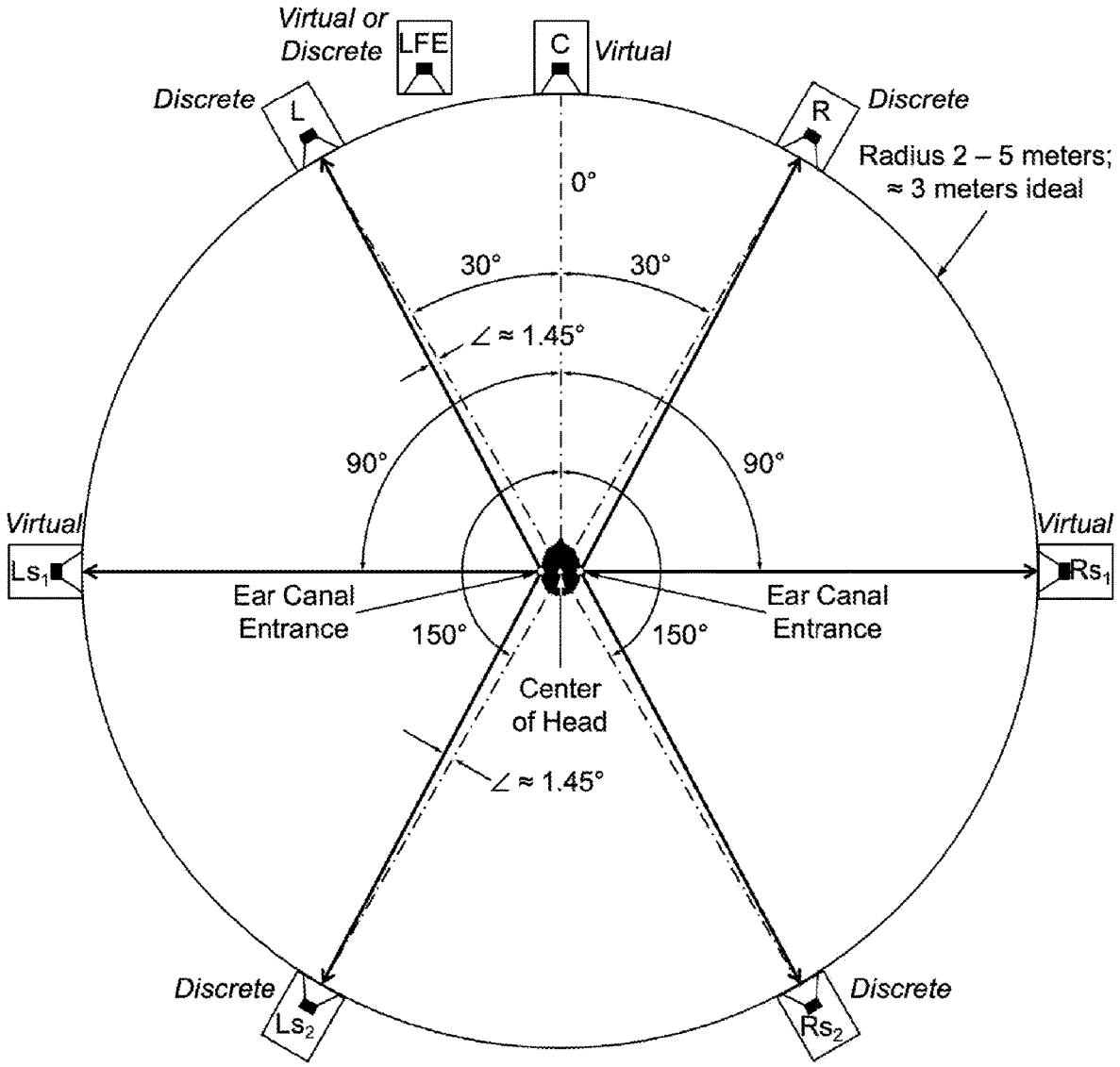
FIG. 4 is a schematic diagram showing the present multichannel headphone system's geometric correlation to an ITU-R (BS.775-2) recommended 7.1 channel loudspeaker setup.

FIG. 4 is a schematic diagram showing the present multichannel headphone system's geometric correlation to an ITU-R (BS.775-2) recommended 7.1 channel loudspeaker setup. Discrete and virtual sound sources reproduced by the headphone are illustrated (similar correlation is expected for 10.2, 11.1, 16.2, etc.)

System Electrical Design

In the first exemplary embodiment, an HRTF characterizing the effect of the listener's head, torso and lap, but excluding the effect of the pinna and ear canal must be derived from acoustical measurements. This transfer function includes amplitude and phase components.

In accordance with the alternative embodiment of the invention, where smaller over-ear and on-ear type headphones, as well as all in-ear type earphones, are used, an HRTF characterizing the effect of the listener's head, torso, lap, pinnae and ear canals must be derived from acoustical measurements. The transfer function in this alternative embodiment includes amplitude and phase components.

Figure 5:
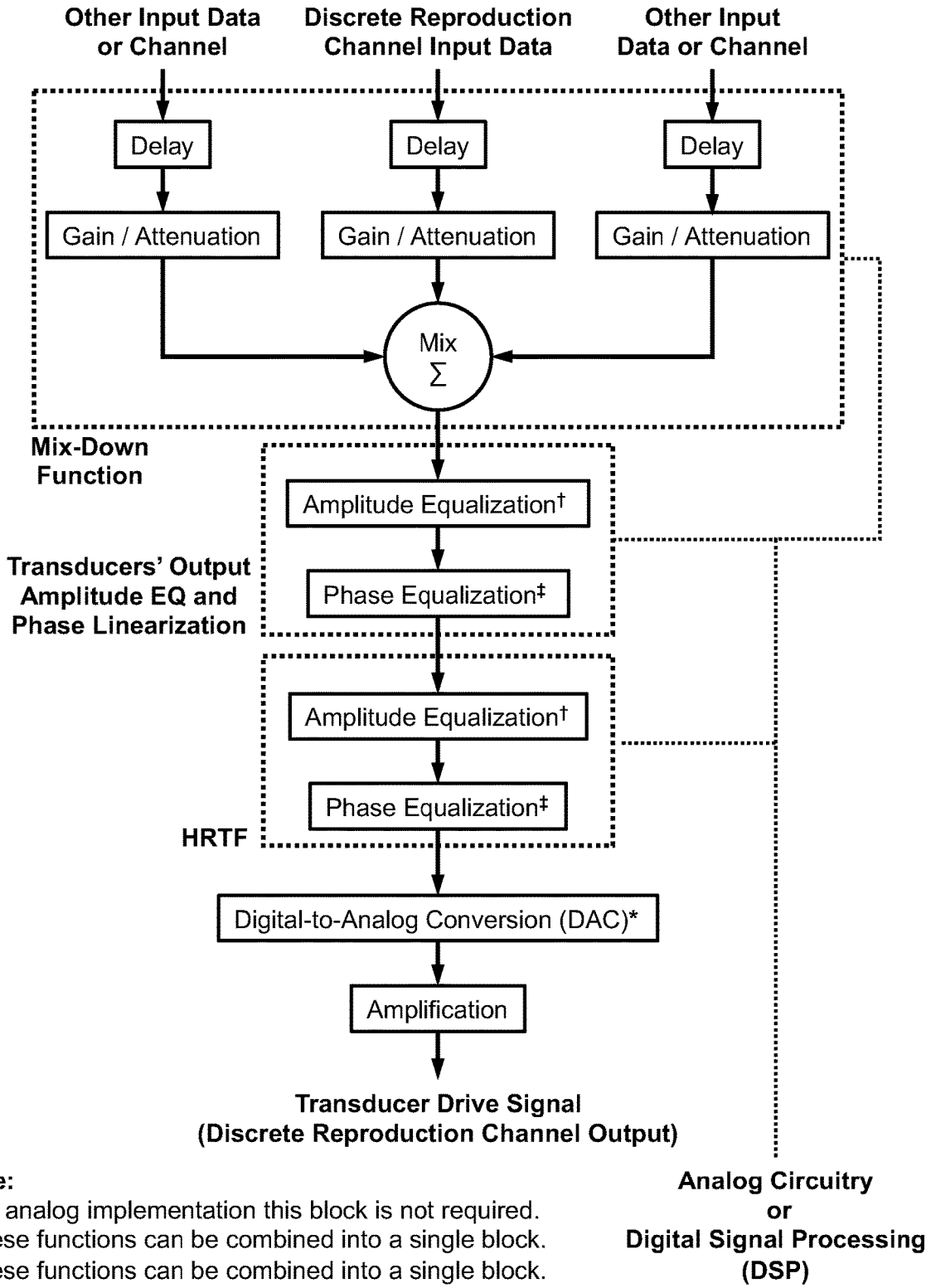
FIG. 5 is a schematic diagram that illustrates an exemplary structure and function of the present multichannel headphone system's electronic implementation, in accordance with the present system and method.

Returning to the first exemplary embodiment, the HRTF can be implemented in the analog domain or the digital domain. When implemented in the analog domain, amplitude equalization circuitry is used with all-pass filters to modify phase response (phase EQ) in the standard manner. As is known by those having ordinary skill in the art, an HRTF derived from measurements can be considered as a type of transfer function with defined amplitude and phase characteristics that vary with frequency, which can be emulated by an electrical circuit using standard modeling and simulation techniques. The resultant electrical transfer function then matches the acoustical transfer function in amplitude and phase. Instead, a variant would be to include only the amplitude equalization circuitry. The HRTF can be implemented in the digital domain using standard digital signal processing (DSP) techniques that utilize common IIR and FIR filters to match the desired amplitude and phase characteristics versus frequency. FIG. 5 illustrates how the HRTF can be implemented in an exemplary electronic structure of the present multichannel headphone, in accordance with the present system and method.

The acoustical output of each transducer 110A, 110B, when mounted in the headphone 100, is equalized to be flat (or tuned explicitly) in amplitude response at the entrance to the ear canal, without the pinna's or ear canal's acoustical effects Equalization can be analog or digital, as implemented for the HRTF.

The acoustical output of each transducer 110A, 110B, when mounted in the headphone 100, is also linearized in phase response (i.e., with a flat group delay versus frequency) at the entrance to the ear canal, without the pinna's or ear canal's acoustical effects. Like equalization, linearization can be analog or digital, as implemented for the HRTF. FIG. 5 illustrates how the amplitude equalization and phase linearization of the transducers' acoustical output can be implemented in an exemplary electronic structure of the present multichannel headphone, in accordance with the present system and method.

The equalization and linearization of the transducers' acoustical output can be combined with the HRTF implementation into a single, more complex function or realized as a cascade of simpler functions, in either analog or digital domains by altering the circuit design or DSP filter topology as necessary to achieve the desired net electro-acoustical transfer function (amplitude and phase).

In accordance with the present system and method, measurements, HRTF derivation and mix-down functions can be summarized as follows. In the first exemplary embodiment, the HRTF is derived from acoustical measurements performed using a common HATS test setup, with the head modified such that: A) no pinnae are present; and B) the microphone is placed at the entrance to the ear canal (i.e., flush with the outer surface of the head). The measurements must exclude both pinna and ear canal effects. In the alternative embodiment, the HRTF is derived from acoustical measurements performed with a standard HATS test setup in the same manner as for the first exemplary embodiment, except using nominal size—and optionally—scaled versions (larger and smaller) of pinnae and ear canals in place. The measurements must include pinna effects, and may need to include ear canal effects, such as when designing IEMs (on-ear type headphones do not need ear canal effects to be included in measurements).

Returning to the first exemplary embodiment of the invention, acoustical measurements for the HRTF derivation are performed in an anechoic chamber (e.g., to 50 Hz or lower). As a variation of the basic method, measurements can also be performed in various (ideal) listening rooms to capture room effects within the HRTF. Acoustical measurements should utilize a high level impulsive source signal, noise-based or maximum length sequence (MLS) stimulus to maximize signal-to-noise ratio (SNR). Preferably, fast-fourier transforms (FFTs) are performed on the captured impulse response to characterize both amplitude and phase response.

$T_o(f)$ is defined as the measured acoustic response (amplitude and phase) of the system output versus frequency. Acoustical measurements for $T_o(f)$ components of the HRTF derivation should be performed with high quality loudspeakers positioned on a designated unit circle (with center point at center of HATS head) at distances and angles prescribed by ITU, Dolby, DTS or other standards for multichannel applications. Four loudspeaker positions should correlate with the angular position on the designated unit circle (relative to the ear canal entrance) for the front and rear (surround) transducers in the headphone. For stereo applications only the front L and front R speakers should be used.

$T_i(f)$ is defined as the measured acoustic response (amplitude and phase) of the system input versus frequency. Acoustical measurements for $T_i(f)$ components of the HRTF derivation should be performed exactly as the acoustical measurements for the $T_o(f)$ components except using standard, free-field microphones located at the same positions as the left and right microphones on the HATS system (at the ear canal entrances). No HATS head should be used for these measurements.

Transfer functions for each audio reproduction channel should be based on the following equation.

$$T_{channel}(f) \equiv T_o(f)/T_i(f) \quad \text{(Eq. 1)}$$

$T_{channel}(f)$ represents the HRTF of each audio channel at the left and right ear canal entrances.

For all virtual channels, including Center (C), Side Surrounds ($L_{S1}$, $R_{S1}$), Low Frequency Effects (LFE), etc., the associated transfer functions needed to fully replicate these channels may be derived from either a discrete source for each native audio channel or a virtual source correlating to those channels as reproduced by the front and rear (surround) transducers in the headphone. In the latter case only four acoustical sources are required for deriving all of the multi-channel transfer functions, regardless of the number of channels. It should be noted that any number of audio source channels can be derived or reproduced by the methodology used by the present system and method.

Utilizing HRTFs measured from discrete source loudspeakers for each native audio channel, the mix-down (as an illustrative example) for 7.1 multichannel applications should be based upon the following guidelines, with the listener's head centered at 0 degrees (on-axis, facing forward):

As is known by those having ordinary skill in the art, there are several source audio channels. Source audio channels are defined as follows: L=Left; R=Right; C=Center; $Ls_1$=Left Side Surround; $Rs_1$=Right Side Surround; $Ls_2$=Left Rear Surround; $Rs_2$=Right Rear Surround; LFE=Low Frequency Effects Center (C) and Side Surround ($Ls_1$, $Rs_1$) channels become virtual when reproduced by the headphone, since there is no discrete reproduction channel or source. The LFE channel is also virtual unless a separate LFE transducer (subwoofer or "shaker" unit) is utilized.

$T_{CL}(f)$≡transfer function of Center (C) channel at left ear canal; $T_{CR}(f)$≡transfer function of Center (C) channel at right ear canal $T_L(f)$≡transfer function of Left (L) channel at left ear canal; $T_R(f)$≡transfer function of Right (R) channel at right ear canal $T_{LS1}(f)$≡transfer function of Left Side Surround ($Ls_1$) channel at left ear canal; $T_{RS1}(f)$≡transfer function of Right Side Surround ($Rs_1$) channel at right ear canal $T_{LS2}(f)$≡transfer function of Left Rear Surround ($Ls_2$) channel at left ear canal; $T_{RS2}(f)$ transfer function of Right Rear Surround ($Rs_2$) channel at right ear canal $T_{LFEL}(f)$≡transfer function of Low Frequency Effects (LFE) channel at left ear canal; $T_{LFER}(f)$≡transfer function of Low Frequency Effects (LFE) channel at right ear canal Transfer functions at the left ear canal are as follows. $L^1 \equiv L \cdot T_L(f)$; $C_L^1 \equiv C \cdot T_{CL}(f)$; $Ls_1^1 \equiv Ls_1 \cdot T_{LS1}(f)$; $Ls_2^1 \equiv Ls_2 \cdot T_{LS2}(f)$; $LFE_L^1$ $LFE \cdot T_{LFEL}(f)$.

Transfer functions at the right ear canal are as follows. $R^1 \equiv R \cdot T_R(f)$; $C_R^1 \equiv C \cdot T_{CR}(f)$; $Rs_1^1 \equiv Rs_1 \cdot T_{RS1}(f)$; $Rs_2^1 \equiv Rs_2 \cdot T_{RS2}(f)$; $LFE_R^1 \equiv LFE \cdot T_{LFER}(f)$.

$\phi_1(f) \equiv -\tau_1$; unity gain transfer function with flat group delay to force virtual source C onto the designated unit circle, defined as the external space equidistant from the center of the listening position or head (calculated based on unit circle radius; e.g., 1.352 msec delay for 3 meter radius)

$\phi_2(f) \equiv -\tau_2$; unity gain transfer function with flat group delay to force virtual sources $Ls_1$ and $Rs_1$ onto the designated unit circle (calculated based on unit circle radius; e.g., 8.741 msec delay for 3 meter radius)

Front Left Mix: $M(L)=(L^1+0.5\cdot C_L^1\cdot\phi_1(f)+0.5\cdot Ls_1^1\cdot\phi_2(f))+0.25\cdot LFE_L^1$ Front Right Mix: $M(R)=(R^1+0.5\cdot C_R^1\cdot\phi_1(f)+0.5\cdot Rs_1^1\cdot\phi_2(f))+0.25\cdot LFE_R^1$ Rear Left Mix: $M(Ls_2)=(Ls_2^1+0.5\cdot Ls_1^1\phi_2(f))+0.25\cdot LFE_L^1$ Rear Right Mix: $M(Rs_2)=(Rs_2^1+0.5\cdot Rs_1^1\cdot\phi_2(f))+0.25\cdot LFE_R^1$ Unity gain flat group delay functions ($\phi_1$ and $\phi_2$) should be convolved as necessary with the $C_L^1$, $C_R^1$ and $Ls_1^1$, $Rs_1^1$ components to force their associated virtual sources onto the unit circle For 5.1 multichannel applications, $Ls_1^1$ and $Rs_1^1$ components should be eliminated If a separate LFE transducer is included in the system, the LFE components should be eliminated from the mix-down and reproduced discretely Utilizing HRTFs measured from only the front and rear (surround) source loudspeakers that correlate to the discrete transducers in the headphone, the mix-down (as an illustrative example) for 7.1 multichannel applications should be based upon the following guidelines, with the listener's head centered at 0 degrees (on-axis, facing forward).

Source audio channels are defined as follows: L=Left; R=Right; C=Center; $Ls_1$=Left Side Surround; $Rs_1$=Right Side Surround; $Ls_2$=Left Rear Surround; $Rs_2$=Right Rear Surround; and LFE=Low Frequency Effects.

Center (C) and Side Surround ($Ls_1$, $Rs_1$) channels become virtual when reproduced by the headphone, since there is no discrete reproduction channel or source. The LFE channel also will be virtual unless a separate LFE transducer (subwoofer or "shaker" unit) is utilized.

$T_L(f)$=transfer function of Left (L) channel at left ear canal and $T_R(f)$=transfer function of Right (R) channel at right ear canal.

$T_{LS2}(f)$=transfer function of Left Rear Surround ($Ls_2$) channel at left ear canal and $T_{RS2}(f)$ transfer function of Right Rear Surround ($Rs_2$) channel at right ear canal.

Transfer functions at the left ear canal are represented as $L^1 \equiv L\cdot T_L(f)$ and $Ls_2^1 \equiv Ls_2\cdot T_{LS2}(f)$.

Transfer functions at the right ear canal are represented as $R^1 \equiv R\cdot T_R(f)$ and $Rs_2^1 \equiv Rs_2\cdot T_{RS2}(f)$.

$\phi_1(f) \equiv -\tau_1$; unity gain transfer function with flat group delay to force virtual source C onto the designated unit circle (calculated based on unit circle radius; e.g., 1.352 msec delay for 3 meter radius).

$\phi_2(f) \equiv -\tau_2$; unity gain transfer function with flat group delay to force virtual sources $Ls_1$ and $Rs_1$ onto the designated unit circle (calculated based on unit circle radius; e.g., 8.741 msec delay for 3 meter radius).

Front Left Mix: $M(L)=L^1+0.5\cdot_{TL}(f)\cdot[C\cdot\phi_1(f)+Ls_1\cdot\phi_2(f)+0.5\cdot LFE]$.

Front Right Mix: $M(R)=R^1+0.5\cdot T_R(f)\cdot[C\cdot\phi_1(f)+Rs_1\cdot\phi_2(f)+0.5\cdot LFE]$.

Rear Left Mix: $M(Ls_2)=Ls_2^1+0.5.\ T_{LS2}(f)\cdot[L_{S1}\phi_2(f)+0.5\cdot LFE]$.

Rear Right Mix: $M(Rs_2)=Rs_2^1+0.5\cdot T_{RS2}(f)\cdot[R_{S1}\phi_2(f)+0.5\cdot LFE]$.

Unity gain flat group delay functions ($\phi_1$ and $\phi_2$) should be convolved as necessary to force the virtual sources C, $Ls_1$ and $Rs_1$ onto the unit circle.

For 5.1 multichannel applications, $Ls_1$ and $Rs_1$ components should be eliminated.

If a separate LFE transducer is included in the system, the LFE components should be eliminated from the mix-down and reproduced discretely.

Stereo applications do not require a mix-down. The final mix reduces to: $M(L)=L^1$ and $M(R)=R^1$.

FIG. 5 illustrates how the mix-down functions, including gain and delay adjustments, can be implemented in an exemplary electronic structure of the present multichannel headphone, in accordance with the present system and method.

Head-tracking systems could alter the mix-down relationships shown above by modifying the gains and delays (phase) of each input channel, as well as the resulting virtual output channel assignment. A multi-axis inertial measurement unit (IMU) could control the virtual channel mixing dynamically, in real time, based upon the continually-monitored head rotation of the listener, up to ±60° or more.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

I claim:

1. A method for providing 3D audio virtualization within headphone-type sound reproduction devices, comprising the steps of:

deriving a composite Head-Related Transfer Function (HRTF) that is uniquely and mathematically correlated in amplitude and phase characteristics versus frequency to an HRTF from external source loudspeakers in an acoustical far-field and matches an HRTF from desired virtual loudspeaker locations in the acoustical far-field consisting of a mutually associated cascade, or complementary series combination, comprising a unique, distance-invariant Pinna-Related Transfer Function (PRTF) of a PRTF component, that includes the acoustical effects due to pinnae and ear canals associated exclusively with acoustic output, being sound, propagating from external source loudspeakers in the acoustical far-field and desired virtual loudspeakers in the acoustical far-field, and a unique, mathematically correlated remainder HRTF, that includes acoustical effects due to head and shoulders associated exclusively with acoustic output, being sound, propagating from the same external source loudspeakers and desired virtual loudspeakers as the PRTF component while excluding acoustical effects due to the pinnae and ear canals;

wherein the remainder HRTF, in conjunction with virtual channel mixing, equalization and delay, is electronically implemented using either digital processing or analog processing, by replicating the transfer function as determined from acoustical measurements by a measurement mechanism that excludes artificial pinnae and ear canals apparatuses from the measurement mechanism and a process, thus omitting the acoustical effects due to pinnae and ear canal effects; and wherein the PRTF component is acoustically implemented and uniquely characterized, to a user through the use of two or more internal transducers of a headphone device that are positioned such that a front plane of a transducer of the two or more internal transducers, the front plane of a diaphragm of the transducer of the two or more internal transducers, a mechanical center of the transducer of the two or more internal transducers, or an acoustical center point of the transducer of the two or more internal transducers are located 25 mm or more from a user's ear canal entrance, whereby of the two or more internal transducers, all the internal transducers' acoustical wavefront is approximated as a plane-wave (planar) and such that associated PRTF is distance-invariant, remaining constant and no longer varying significantly with distance, and oriented such that the 0° axis of acoustical output of all the internal transducers of the two or more internal transducers is aligned with and approximately equal to the 0° axis of acoustical output of external source or virtual loudspeakers positioned in an acoustical far-field, defined as a spherical volume surrounding the user's head or ear canal with a radius of 1 meter or more, such that, of the two or more internal transducers, front left and right internal transducers' acoustical axes subtend an angle of between ±10°-80° relative to the front forward orientation of the user's head, defined as 0°, and, of the two or more internal transducers, rear left and right transducers' acoustical axes subtend an angle of between ±110°-170° relative to the front forward orientation of the user's head, defined as 0°; and wherein the derived, composite HRTF replicates the acoustical amplitude (spectral) and phase (time varying) characteristics versus frequency, over the sound reproduction range of the headphone device, in a manner consistent with and mathematically correlated to the HRTF from external source and virtual loudspeakers located in the acoustical far-field relative to the ear canal; and wherein there is a direct, one-to-one correlation between an audio input channel, the external source loudspeaker associated with the derivation of the composite HRTF and an internal headphone transducer of the two or more internal transducers, for at least two channels of the headphone device.

2. The method of claim 1, wherein the remainder HRTF, virtual channel mixing, equalization and delay are electronically implemented using a digital signal processor.

3. The method of claim 1, wherein the remainder HRTF is non-personalized.

4. The method of claim 1, wherein the remainder HRTF is personal.

5. The method of claim 1, wherein the transducer of the two or more internal transducers is a speaker.

6. The method of claim 1, wherein the acoustical output wave front of the transducer of the two or more internal transducers, encompasses (overlaps) 75% or greater of the area of the user's pinnae, without physical compression.

7. A method for providing 3D audio virtualization within a headphone-type sound reproduction device, wherein the headphone-type sound reproduction device is selected from the group consisting of smaller over-ear headphones, on-ear type headphones, and in-ear type earphones, and wherein the headphone-type sound reproduction device has smaller diameter transducers located <25 mm from a user's ear canal, the method comprising the steps of:

deriving a composite Head-Related Transfer Function (HRTF) that is uniquely and mathematically correlated in amplitude and phase characteristics versus frequency to external source loudspeakers in an acoustical far-field and matches an HRTF from desired virtual loudspeaker locations in the acoustical far-field consisting of a mutually associated cascade, or complementary series combination, comprising a unique, distance-invariant Pinna-Related Transfer Function (PRTF), that includes the acoustical effects due to pinnae only or pinnae and ear canals associated exclusively with acoustic output, which is sound, propagating from external source loudspeakers in the acoustical far-field and desired virtual loudspeakers in the acoustical far-field, and a unique, mathematically correlated remainder HRTF, that includes acoustical effects due to at least one of the group consisting of head and shoulders associated exclusively with acoustic output, which is sound, propagating from the same external source loudspeakers and desired virtual loudspeakers as a PRTF component, while excluding acoustical effects due to the pinnae and ear canals;

wherein a complete HRTF that is uniquely correlated to a HRTF from external source loudspeakers in the acoustical far-field and matches the HRTF from desired virtual loudspeaker locations in the acoustical far-field, comprising the composite HRTF and a remainder HRTF, in conjunction with virtual channel mixing, equalization and delay, is electronically implemented using either digital processing or analog processing;

wherein an audio drive signal comprising the complete HRTF and audio source content is reproduced by two or more internal transducers of a headphone device such that a resultant acoustical wavefront, defined as the acoustical output on the 0° axis of the two or more internal transducers, impinging on or within the ear canal, is aligned with and approximately equal to an acoustical wavefront of external source or virtual loudspeakers, defined as the acoustical output on the 0° axes of the external source or virtual loudspeakers, positioned in an acoustical far-field, defined as a spherical volume surrounding the user's head or ear canal with a radius of 1 meter or more within limits defined for acoustical axes of front left and right transducers of the two or more internal transducers of subtending an angle of between ±10° to 80° relative to front forward orientation of the user's head, defined as 0°, and within limits defined for acoustical axes of rear left and right transducers of the two or more internal transducers of subtending an angle of between ±110°-170° relative to the front forward orientation of the user's head, defined as 0°;

wherein the derived, composite HRTF replicates the acoustical amplitude (spectral) and phase (time varying) characteristics versus frequency, over the sound reproduction range of the headphone device, in a manner consistent with and mathematically correlated to the HRTF from external source and virtual loudspeakers located in the acoustical far-field relative to the ear canal; and wherein there is a direct, one-to-one correlation between an audio input channel, the external source loudspeaker associated with the derivation of the composite HRTF and an internal headphone transducer of the two or more internal transducers, for at least two channels of the headphone device.

8. The method of claim 7, wherein the complete HRTF, virtual channel mixing, equalization and delay are electronically implemented using a digital signal processor.

9. The method of claim 7, wherein the PRTF and remainder HRTF are non-personalized.

10. The method of claim 7, wherein the PRTF and remainder HRTF are personal.

11. The method of claim 7, wherein the PRTF is personal and remainder HRTF is non-personalized.

12. The method of claim 7, wherein the PRTF is non-personalized and remainder HRTF is personal.

13. The method of claim 7, wherein each transducer of the two or more internal transducers is a planar type speaker that generates a planar wave front.

* * * * *